US010772402B2

(12) United States Patent
Sheikh et al.

(10) Patent No.: US 10,772,402 B2
(45) **Date of Patent: *Sep. 15, 2020**

(54) HARD-SIDED LUGGAGE BAG WITH FRONT LID

(71) Applicant: HEYS INTERNATIONAL LTD., Mississauga (CA)

(72) Inventors: Emran Y. Sheikh, Mississauga (CA); Alden Evangelista, Woodbridge (CA)

(73) Assignee: HEYS INTERNATIONAL LTD., Mississauga (CA)

( * ) Notice: Subject to any disclaimer, the term of this patent is extended or adjusted under 35 U.S.C. 154(b) by 287 days.

This patent is subject to a terminal disclaimer.

(21) Appl. No.: 15/875,338

(22) Filed: Jan. 19, 2018

(65) Prior Publication Data

US 2018/0140065 A1 May 24, 2018

Related U.S. Application Data

(63) Continuation of application No. 14/361,981, filed as application No. PCT/CA2013/050078 on Feb. 1, 2013, now Pat. No. 9,894,970.

(Continued)

(30) Foreign Application Priority Data

Aug. 10, 2012 (CA) ..... 2785061

(51) Int. Cl.
*A45C 5/14* (2006.01)
*A45C 5/03* (2006.01)

(Continued)

(52) U.S. Cl.
CPC ..... *A45C 5/14* (2013.01); *A45C 5/03* (2013.01); *A45C 5/06* (2013.01); *A45C 7/0022* (2013.01); *A45C 13/00* (2013.01); *A45C 2200/00* (2013.01)

(58) Field of Classification Search
CPC ..... A45C 13/10; A45C 5/06; A45C 7/0027; A45C 5/14; A45C 7/0022

(Continued)

(56) References Cited

U.S. PATENT DOCUMENTS 2,907,420 A 10/1959 Doppelt
6,179,101 B1 1/2001 Lin (Continued)

FOREIGN PATENT DOCUMENTS

CA 2322214 A1 9/1999
CA 2785061 C 10/2013

(Continued)

OTHER PUBLICATIONS

Search Report dated Mar. 18, 2014 in respect of European Patent Application No. 13747635.4.

(Continued)

*Primary Examiner* — Sue A Weaver
(74) *Attorney, Agent, or Firm* — Bereskin & Parr LLP/S.E.N.C.R.L., s.r.l.

(57) ABSTRACT

A hard-sided luggage bag includes at least one shell portion, and has a front side, a back side, and a bottom side extending between the front and back sides. The least one shell portion encloses a storage compartment and includes an access opening permitting access to the storage compartment. The access opening is formed in at least part of the front side and is spaced apart from the bottom side. At least one lid is releasably coupled to the at least one shell portion to cover the access opening.

20 Claims, 15 Drawing Sheets

Related U.S. Application Data

(60) Provisional application No. 61/618,384, filed on Mar. 30, 2012.

(51) Int. Cl.
*A45C 7/00* (2006.01)
*A45C 13/00* (2006.01)
*A45C 5/06* (2006.01)

(58) Field of Classification Search
USPC ..... 190/109, 18 A, 107, 903
See application file for complete search history.

(56) References Cited

U.S. PATENT DOCUMENTS

| | | | |
|---|---|---|---|
| D438,005 | S | 2/2001 | Tiramani et al. |
| D462,169 | S | 9/2002 | Giovanni |
| 6,460,668 | B1 | 10/2002 | Godshaw et al. |
| 6,557,702 | B1 | 5/2003 | Sanderson et al. |
| 7,195,109 | B2 | 3/2007 | Mitchell et al. |
| 9,894,970 | B2 | 2/2018 | Sheikh et al. |
| 2002/0088679 | A1 | 7/2002 | Abraham |
| 2004/0090047 | A1 | 5/2004 | Kang et al. |
| 2005/0056510 | A1 | 3/2005 | Hsieh |
| 2005/0072642 | A1 | 4/2005 | Sanchez |
| 2006/0196743 | A1 | 9/2006 | Lin |
| 2008/0251341 | A1 | 10/2008 | Murdoch et al. |
| 2011/0186396 | A1 | 8/2011 | Sheikh |
| 2011/0186398 | A1 | 8/2011 | Sheikh |
| 2011/0272232 | A1 | 11/2011 | Sheikh |
| 2012/0181129 | A1 | 7/2012 | Lai |
| 2013/0096721 | A1 | 4/2013 | Iyengar et al. |
| 2013/0098721 | A1 | 4/2013 | Lai |
| 2014/0166416 | A1 | 6/2014 | Krulik et al. |
| 2014/0353104 | A1 | 12/2014 | Sheikh et al. |
| 2015/0130148 | A1 | 5/2015 | Meersschaert et al. |
| 2016/0174673 | A1 | 6/2016 | Lai |

FOREIGN PATENT DOCUMENTS

| | | | |
|---|---|---|---|
| CN | 2738610 | Y | 11/2005 |
| CN | 201197447 | Y | 2/2009 |
| CN | 201409571 | Y | 2/2010 |
| DE | 202011100927 | U1 | 9/2011 |
| EP | 2685863 | B1 | 9/2016 |
| GB | 2415955 | A | 1/2006 |
| NL | 1016022 | C2 | 2/2002 |
| TW | M404640 | U1 | 6/2011 |
| WO | 99/44807 | A1 | 9/1999 |
| WO | 2013/005166 | A1 | 1/2013 |
| WO | 2013/142984 | A1 | 10/2013 |

OTHER PUBLICATIONS

Communication dated May 2, 2014 in respect of European Patent Application No. 13747635.4.

Excerpt of www.ebags.com, Heys USA EZ Computer Case 21" Carry-On, Dec. 19, 2013.

Excerpt of www.koffer-arena.de, Stratic Melton 2-Rollen Kabinentrolley 56cm, Dec. 19, 2013.

Excerpt of www.amazon.de, Stratic Koffer Melton, 56 cm, Jan. 8, 2014.

Excerpt of www.rimowa.de, Salsa Deluxe Hybrid Brown, Dec. 19, 2013.

Excerpt of www.luggagepros.com, Rimowa Salsa Deluxe 32" 3 Suiter Multiwheel, Mar. 26, 2012.

Excerpt of www.ebags.com, Samsonite Lift 29" Spinner Expandable, Mar. 26, 2012.

International Search Report and Written Opinion dated May 8, 2013 in respect of International Application No. PCT/CA2013/050078.

Communication dated Feb. 23, 2015 in respect of European Patent Application No. 13747635.4.

Communication dated Oct. 9, 2015 in respect of European Patent Application No. 13747635.4.

Non-Final Rejection dated Aug. 28, 2015 in respect of U.S. Appl. No. 14/361,981.

Final Rejection dated Mar. 4, 2016 in respect of U.S. Appl. No. 14/361,981.

Non-Final Rejection dated Jul. 25, 2016 in respect of U.S. Appl. No. 14/361,981.

Final Rejection dated Jan. 9, 2017 in respect of U.S. Appl. No. 14/361,981.

HARD-SIDED LUGGAGE BAG WITH FRONT LID

CROSS REFERENCE TO RELATED APPLICATIONS

This application is a continuation of U.S. application Ser. No. 14/361,981 filed on May 30, 2014, which is a national stage entry of International Application No. PCT/CA2013/050078 filed on Feb. 1, 2013, which claims priority from U.S. Application No. 61/618,384 filed Mar. 30, 2012 and Canadian Application No. 2,785,061 filed Aug. 10, 2012, and the entire contents of each are hereby incorporated herein by reference.

TECHNICAL FIELD

The present disclosure relates to hard-sided luggage.

BACKGROUND

The following paragraphs are not an admission that anything discussed in them is prior art or part of the knowledge of persons skilled in the art.

Hard-sided luggage has become increasingly popular in recent years. Hard-sided luggage can provide several benefits versus soft-sided baggage, including attractiveness, durability and light weight. One important benefit to using hard-sided luggage is that contents tend to be well protected. Hard-sided luggage can include features such telescoping handles, and swivel wheels that allow for easy maneuvering. Hard-sided luggage can also include a secure locking mechanism, including TSA-approved locks, for example. Internally, hard-sided luggage can include features such as dividers, pockets and straps to hold its contents in place.

Hard-sided luggage can be constructed of several different materials, including aluminum, polycarbonate, ABS and polypropylene. Hard-sided luggage is available in endless colors and designs, and the shells can be scratch-resistant, dent-resistant, and generally waterproof.

SUMMARY

The following paragraphs are intended to introduce the reader to the more detailed description that follows and not to define or limit the claimed subject matter.

According to an aspect of the present disclosure, a hard-sided luggage bag can include: at least one shell portion having a front side, a back side, and top, bottom, left and right sides extending generally between the front and back sides, the front and back sides spaced from one another in a depth direction, the top and bottom sides spaced from one another in a height direction, the at least one shell portion enclosing a storage compartment and including an access opening permitting access to the storage compartment, the access opening formed in at least part of the front side; and at least one lid releasably coupled to the at least one shell portion to cover the access opening. The at least one lid can be releasably joined to the at least one shell portion along a bottom edge of the access opening. The bottom edge can be spaced from the bottom side in the height direction. The bottom edge can extend across the front side between the left and right sides. The at least one lid can be releasably joined to the at least one shell portion along left, top and right edges of the access opening that extend across the respective left, top and right sides of the at least one shell portion. The at least one shell portion can include a rearward shell portion coupled to a forward shell portion by at least one of a main joint and an expansion section that, in the depth direction, is generally intermediate the front and back sides, the forward shell portion including the access opening. Along the left side, a first dimension between an interior edge of the forward shell portion and the left edge of the access opening can be less than a second dimension between the left edge of the access opening and the bottom edge of the access opening at the front side. The first and second dimensions can be parallel to the depth direction.

According to an aspect of the present disclosure, a hard-sided luggage bag can include: a rearward shell portion coupled to a forward shell portion, the shell portions together having a front side, a back side spaced from the front side, and top, bottom, left and rights sides extending generally between the front and back sides, the front and back sides spaced from one another in a depth direction, the top and bottom sides spaced from one another in a height direction, the shell portions being coupled by at least one of a main joint and an expansion section that, in the depth direction, is generally intermediate the front and back sides, the shell portions enclosing a storage compartment, the forward shell portion including an access opening permitting access to the storage compartment, the access opening formed in at least part of the front side, the access opening including a bottom edge that is spaced from the bottom side in the height direction and extends across the front side between the left and right sides, and the access opening including left, top and right edges that extend across respective left, top and right sides of the forward shell portion; and a lid coupled to the forward shell portion to cover the access opening and defining a substantial portion of the front side of the bag, the lid releasably joined to the forward shell portion by a lid closure zipper along at least a portion of the bottom, left and top edges of the access opening. Along the left side of the bag at a vertical position that, in the height direction, is generally intermediate the top and bottom sides, a first horizontal dimension between an interior edge of the forward shell portion and the left edge of the access opening can be less than a second horizontal dimension between the lid closure zipper at the left edge of the access opening and the front side of the lid.

According to an aspect of the present disclosure, a hard-sided luggage bag can include: a rearward shell portion releasably joined to a forward shell portion along a main joint, the shell portions enclosing a storage compartment, the main joint permitting a first way to access the storage compartment by releasing a main closure mechanism, the forward shell portion including an access opening permitting a second way to access the storage compartment, separate from the first way, by releasing a lid closure mechanism; and a lid releasably coupled to the forward shell portion to cover the access opening. The lid can define a substantial portion of a front side of the bag. The access opening can include bottom, left and right edges. The bottom edge can be spaced vertically from a bottom side of the bag in a height direction, and can extend horizontally across a front side of the forward shell portion. The left and right edges of the access opening can extend across respective left and right sides of the forward shell portion. Along the left side, a first horizontal dimension between an interior edge of the forward shell portion and the left edge of the access opening can be less than a second horizontal dimension between the left edge of the access opening and the front side of the bag as defined by the lid.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, and the applicant(s), inventor(s) and/or owner(s) do not intend to abandon, disclaim or dedicate to the public any such invention by its disclosure in this document.

Figure 1:
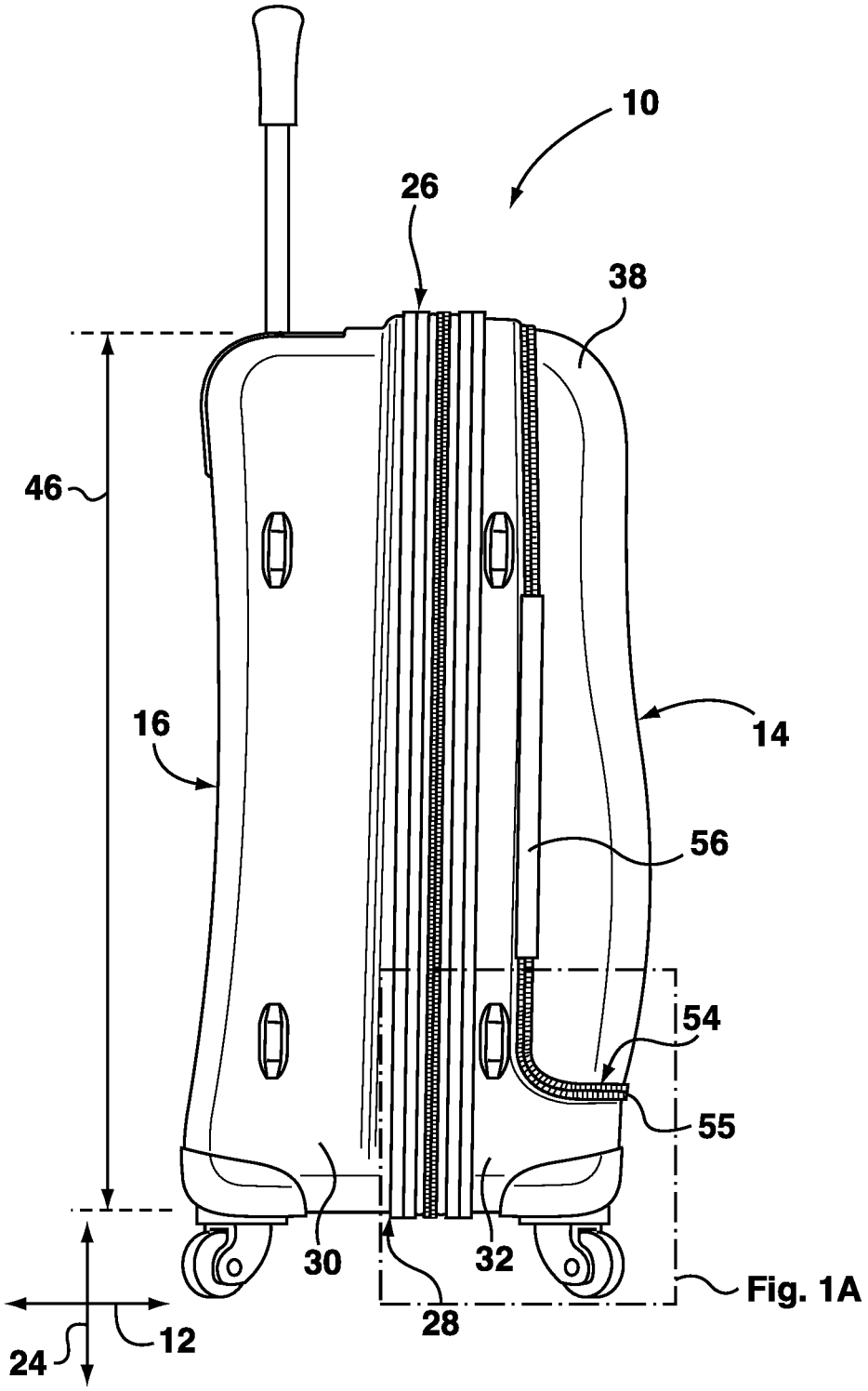
FIGS. 1 and 2 are left side and front views of a first example of a hard-sided luggage bag.
Figure 2:
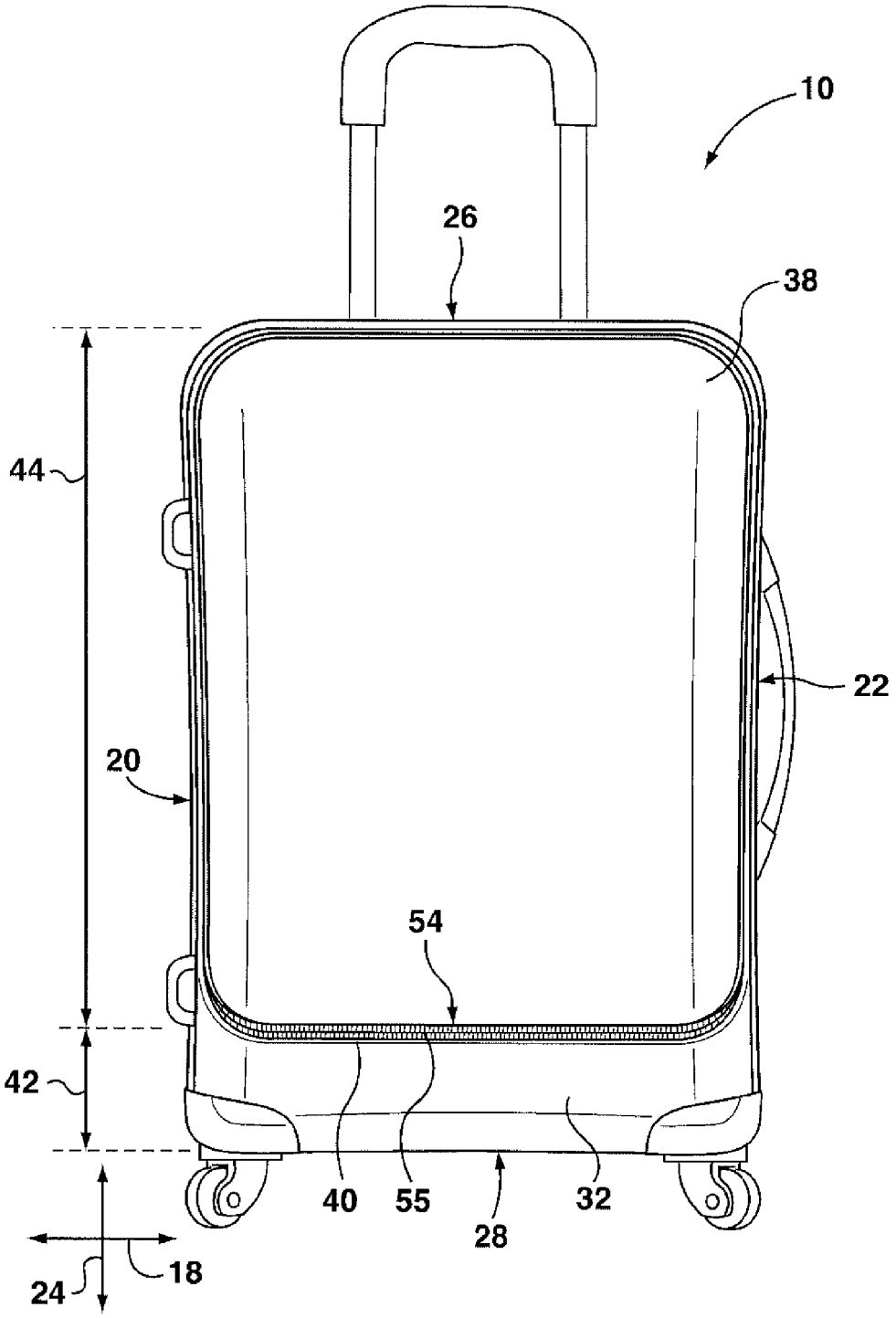

Referring to FIGS. 1 and 2, an example of a hard-sided luggage bag is shown generally at 10. The bag 10 extends in a depth direction 12 between a front side 14 and a back side 16. The bag 10 extends in a width direction 18 between a left side 20 and a right side 22. The bag 10 extends in a height direction 24 between a top side 26 and a bottom side 28.

In the example illustrated, the bag 10 includes a rearward shell portion 30 and a forward shell portion 32. The shell portions 30, 32 can be generally complementary in size and shape. The shell portions 30, 32 can be formed of a variety of materials, including, for example but not limited to, aluminum, polycarbonate, ABS, polypropylene, and composites thereof. The shell portions 30, 32 can include an interior lining formed of fabric material.

Figure 3:
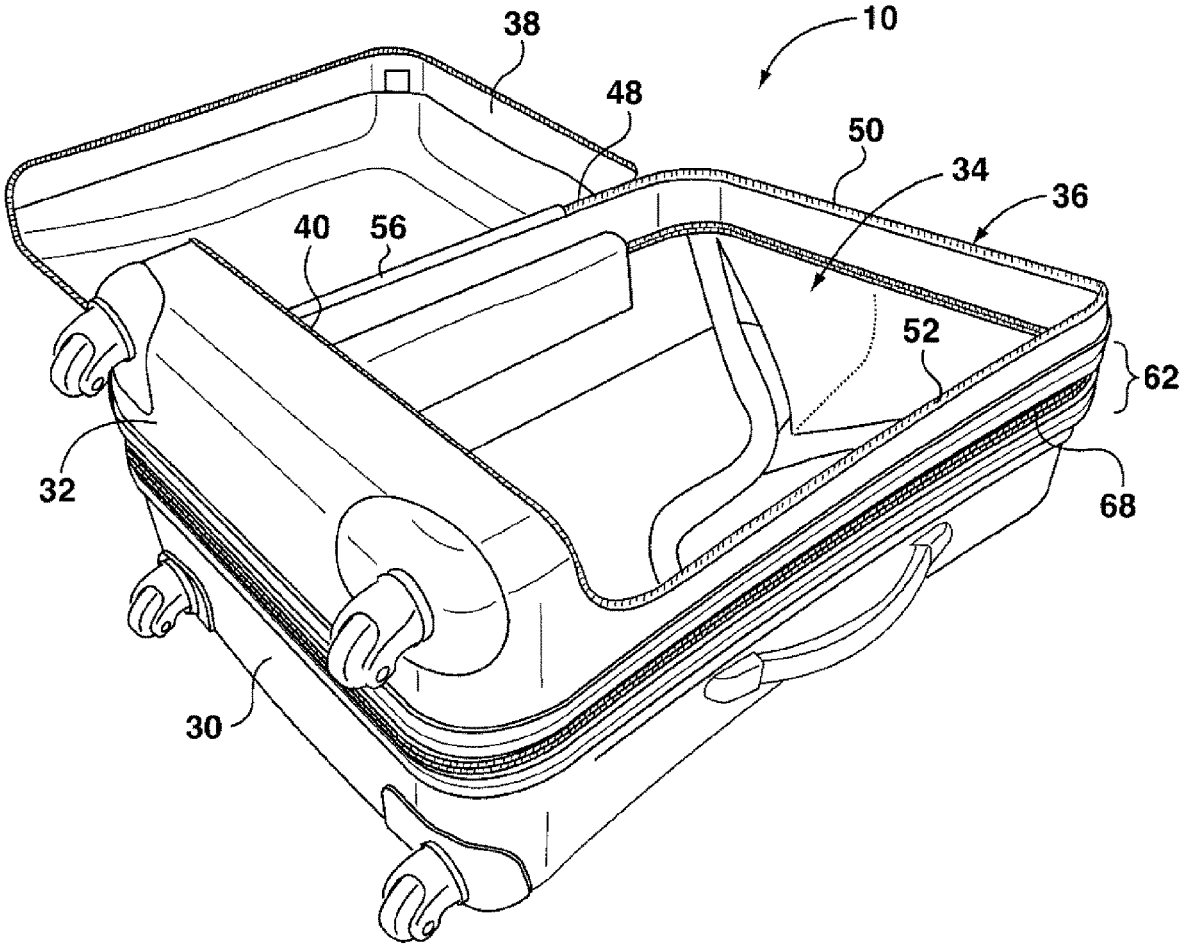
FIG. 3 is a perspective view of the hard-sided luggage bag of FIGS. 1 and 2, shown with a lid in an open position.

Referring particularly to FIG. 3, the shell portions 30, 32 are coupled together to enclose a storage compartment 34. The forward shell portion 32 includes an access opening 36 formed therein. The access opening 36 permits access to the storage compartment 34. A lid 38 is coupled to the forward shell portion 32. In an open position, as shown in FIG. 3, the lid 38 allows access to the storage compartment 34 through the access opening 36. In a closed position, as shown in FIGS. 1 and 2, the lid 38 covers the access opening 36.

In the example illustrated, the lid 38 is shown to be formed of a shell portion, generally in continuity with the forward shell portion 32. In some examples, the lid 38 can include one or more zippered pockets arranged along an interior side thereof.

Alternatively, in soft-sided examples, the lid can be formed of at least one fabric portion (not shown), which can be formed of, for example but not limited to, polyester, nylon or polypropylene fabric materials. In such examples, the at least one fabric portion can include one or more zippered pockets, that can be accessible from the exterior of the bag. In other hybrid examples, the lid can be formed of a combination of at least one shell portion and fabric materials.

Furthermore, in yet other examples, the lid can be formed of two portions (or more), that are configured to open and close independently of one another. In such examples, the lid portions can be releasably joined to one another, e.g., with a zipper or another suitable closure mechanism, roughly midway across the access opening between a bottom edge and a top edge. Alternatively, the access opening can include two separate sections, separated by a strut element (not shown) that, for example, extends across the access opening between a left edge and a right edge. In such examples, each of the lids can be releasably joined to the strut element, and coupled to the forward shell portion along one of its edges by respective hinges.

Referring back to FIGS. 1 and 2, and with continued reference to FIG. 3, the lid 38 is releasably joined to the forward shell portion 32 along a bottom edge 40 of the access opening 36. The bottom edge 40 is shown to be spaced apart a first dimension 42 (shown in FIG. 2) from the bottom side 28 in the height direction 24. Thus, in the height direction 24, the access opening 36 has a second dimension 44 (shown in FIG. 2) that is less than a third dimension 46 (shown in FIG. 1) of the bag 10 between the top and bottom sides 26, 28. With the access opening 36 and the lid 38 spaced apart from the bottom side 28 in this manner, a lower portion of the bag 10 can provide a relatively rigid structure, which can be maintained when the lid 38 is in the open position.

In the example illustrated, the bottom edge 40 extends generally across the front side 14 between the left and right sides 20, 22. The lid 38 is further releasably joined to the forward shell portion 32 along a left edge 48, a top edge 50 and a right edge 52 of the access opening 36 that extend generally across the left, top and right sides 20, 26, 22, respectively.

The lid 38 is releasably joined to the forward shell portion 32 along the edges 40, 48, 50, 52 by a lid closure mechanism 54. In the example illustrated, the lid closure mechanism 54 includes a lid zipper 55.

The lid 38 is shown to be releasably joined only partly along the left edge 48, as the lid 38 is connected to the forward shell portion 32 generally along the left edge 48 by a hinge 56. In other examples, a hinge connecting the lid 38 and the forward shell portion 32 can be arranged on the bottom edge 40, which can reduce the risk of contents falling out of the access opening 36 if the lid 38 is opened while the bag 10 is disposed in an upright position. In such examples, the bag 10 can include gussets (not shown), provided alongside the edges 48, 52, to help to prevent contents from falling out of the access opening 36 when the lid 38 is opened and the bag 10 is disposed in the upright position. In yet other examples, a hinge connecting the lid 38 and the forward shell portion 32 can be arranged on the top edge 50, or on the right edge 52. Various configurations are possible.

Figure 4:
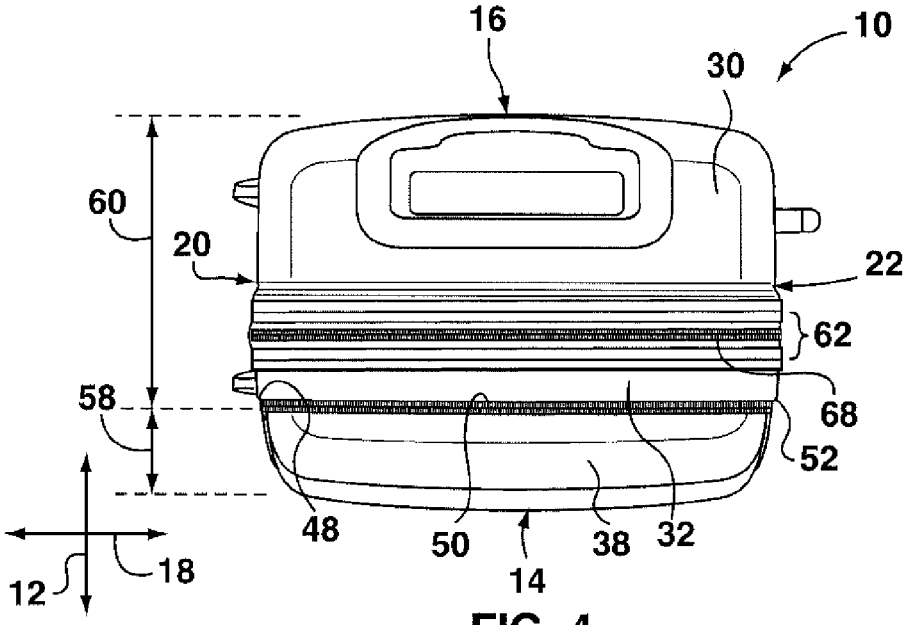
FIGS. 4, 5, 6 and 7 are top, bottom, right side, and back views of the hard-sided luggage bag of FIGS. 1 and 2.

In the depth direction 12, the edges 48, 50, 52 are arranged generally adjacent to the front side 14. As shown in FIG. 4, in the depth direction 12, the access opening 36 has a fourth dimension 58 that is substantially less than a fifth dimension 60 of the bag 10 between the back side 14 and the edges 48, 50, 52. Thus, referring back to FIG. 3, users can have access to almost the full depth of the storage compartment 34 through the access opening 36. Furthermore, in some examples, as illustrated, the sides 20, 26, 22 can present a generally uniform dimension in the depth direction 12 so that the storage compartment 34 is of a generally uniform depth over the edges 48, 50, 52 of the access opening 36.

Figure 1A:
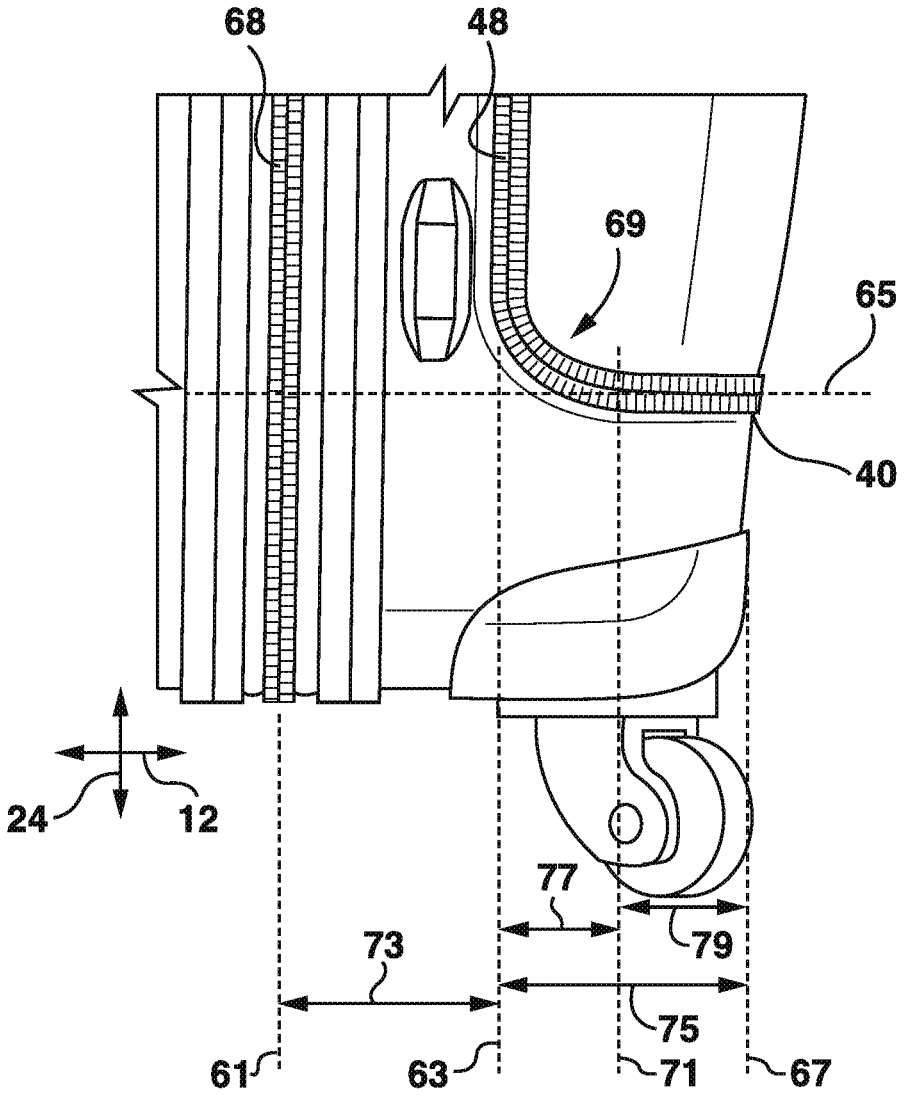
FIG. 1A is a detailed view of a portion of the hard-sided luggage bag of FIG. 1.
Figure 6:
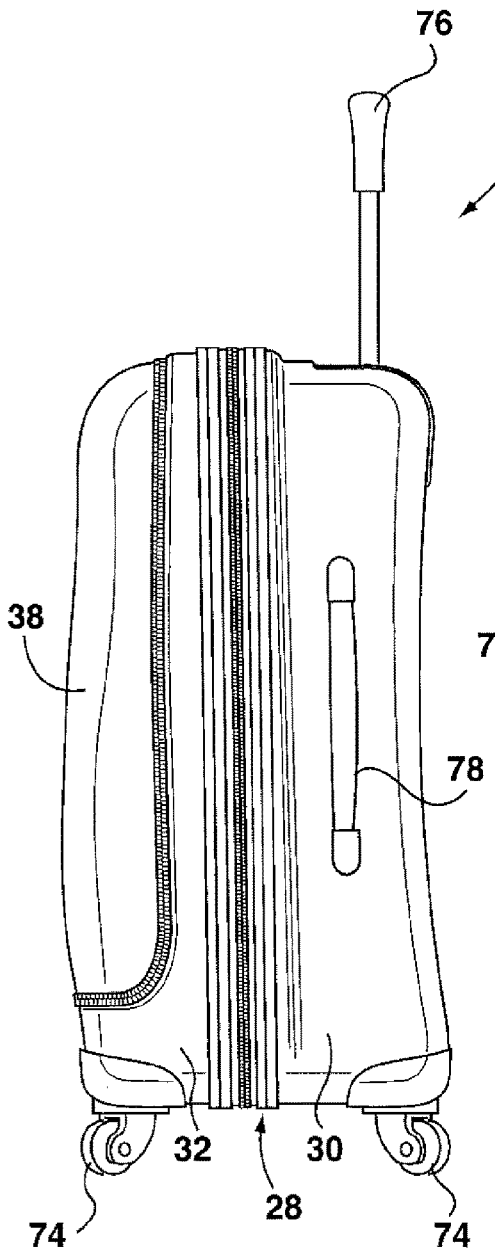

Referring to FIGS. 1 and 1A, an interior edge of the forward shell portion 32 defines a vertical line 61, the left edge 48 defines a vertical line 63, and the bottom edge 40 defines a horizontal line 65 and a vertical line 67 at the front side of the bag. In the example illustrated, the access opening 36 includes a curved bottom corner 69 that is arranged intermediate of the bottom edge 40 and the left edge 48. A vertical line 71 intersects a boundary between the curved bottom corner 69 and the bottom edge 40. The lines 61, 63, 67, 71 are each parallel to the height direction 24, and the line 65 is parallel to the depth direction 12. In the example illustrated, the bottom edge 40 extends horizontally parallel to the depth direction 12 between the front side of the bag and the curved corner 69. As illustrated, a horizontal dimension 73 between the lines 61, 63 is less than a horizontal dimension 75 between the lines 63, 67, and a horizontal dimension 77 between the lines 63, 71 is less than a horizontal dimension 79 between the lines 71, 67. FIG. 6 shows generally the same configuration on the other side of the bag 10.

Figure 5:
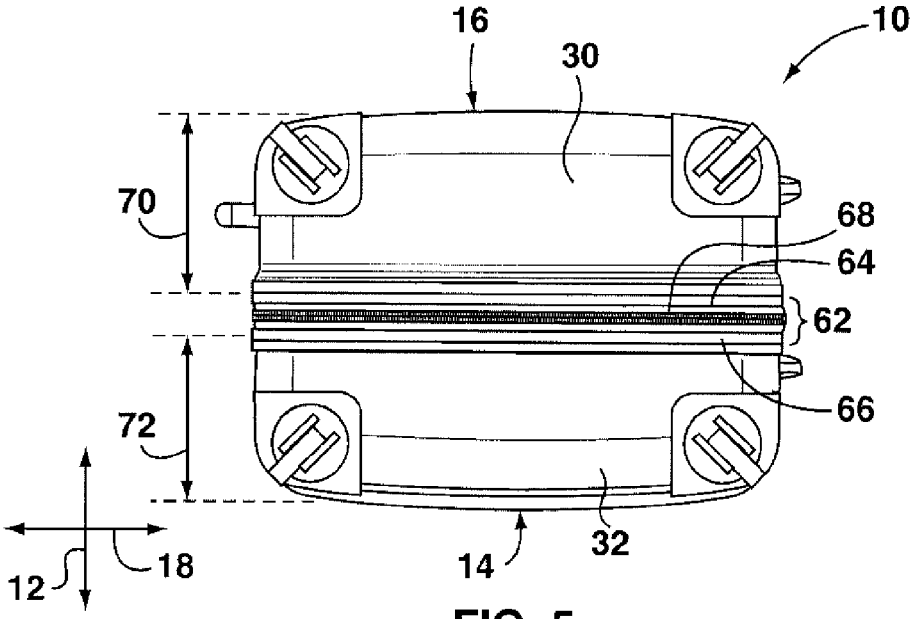

Referring now to FIG. 5, an expansion section 62 is shown to be connected to inner edges 64, 66 of the shell portions 30, 32, respectively. In the example illustrated, the expansion section 62 includes an expansion zipper 68, which, when released, increases space between the inner edges 64, 66 thereby increasing a depth dimension of the bag 10 (i.e. in the depth direction 12).

In the example illustrated, the expansion section 62 is shown to be generally intermediate the front and back sides 14, 16 so that, in the depth direction 12, a sixth dimension 70 of the rearward shell portion 30 between the back side 16 and the inner edge 64 is similar to a seventh dimension 72 of the forward shell portion 32 between the inner edge 66 and the front side 14. In this manner, a center of gravity of the bag 10 can remain generally balanced between the sides 14, 16 once the expansion zipper 68 is released.

Furthermore, referring to FIGS. 3, 4 and 5, the expansion section 62 is shown to be generally spaced apart from the access opening 36 and the lid 38, with the edges 40, 48, 50, 52 of the access opening 36 being generally intermediate the expansion section 62 and the front side 14. For users, this can help to reduce confusion between the lid zipper 55 and the expansion zipper 68.

Figure 7:
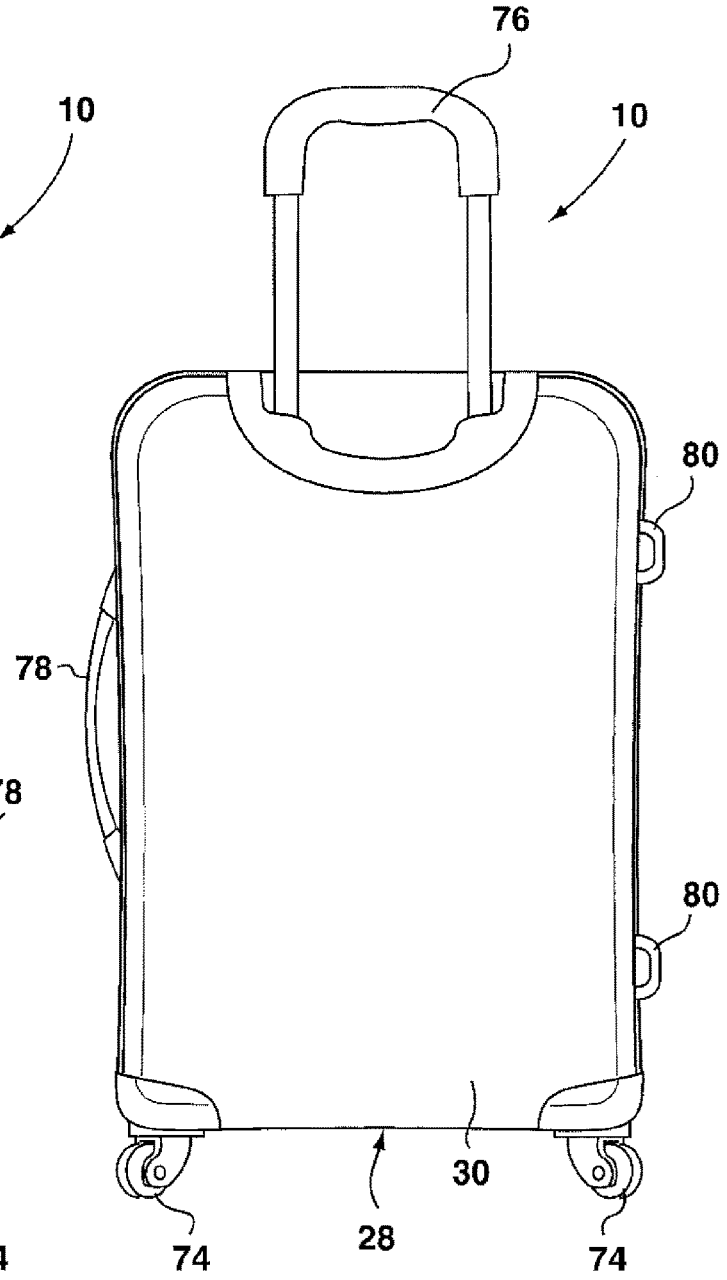

Referring now to FIGS. 6 and 7, the bag 10 includes wheels 74 arranged on the bottom side 28. Some or all of the wheels 74 can be swivel wheels. In the example illustrated, two of the wheels 74 are fixed to the rearward shell portion 30, and two of the wheels 74 are fixed to the forward shell portion 32. With the lid 38 spaced apart from the bottom side 28, the lid 38 can be opened without interfering with the wheels 74. Furthermore, as mentioned above, with the access opening 36 and the lid 38 spaced apart from the bottom side 28, a lower portion of the bag 10 can provide a relatively rigid structure, which can bear the weight of the bag 10 and its contents, and can serve as a stable base for attachment of the wheels 74.

In the example illustrated, the bag 10 further includes a top handle 76, a side handle 78 and feet 80. As shown, the top handle 76 can be retractable, and suitable for guiding the bag 10 on the wheels 74.

Figure 8:
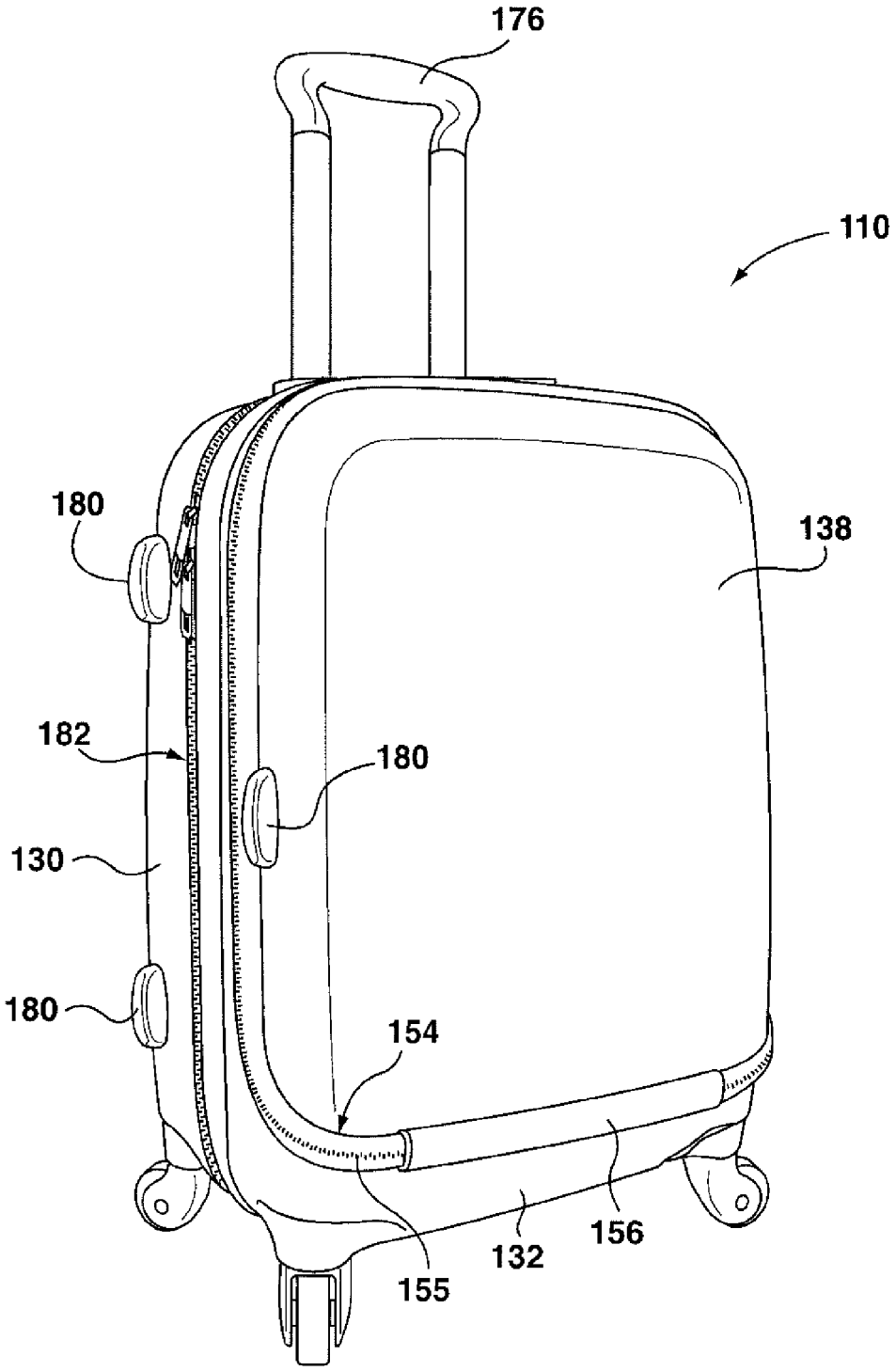
FIG. 8 is a perspective view of a second example of a hard-sided luggage bag.
Figure 9:
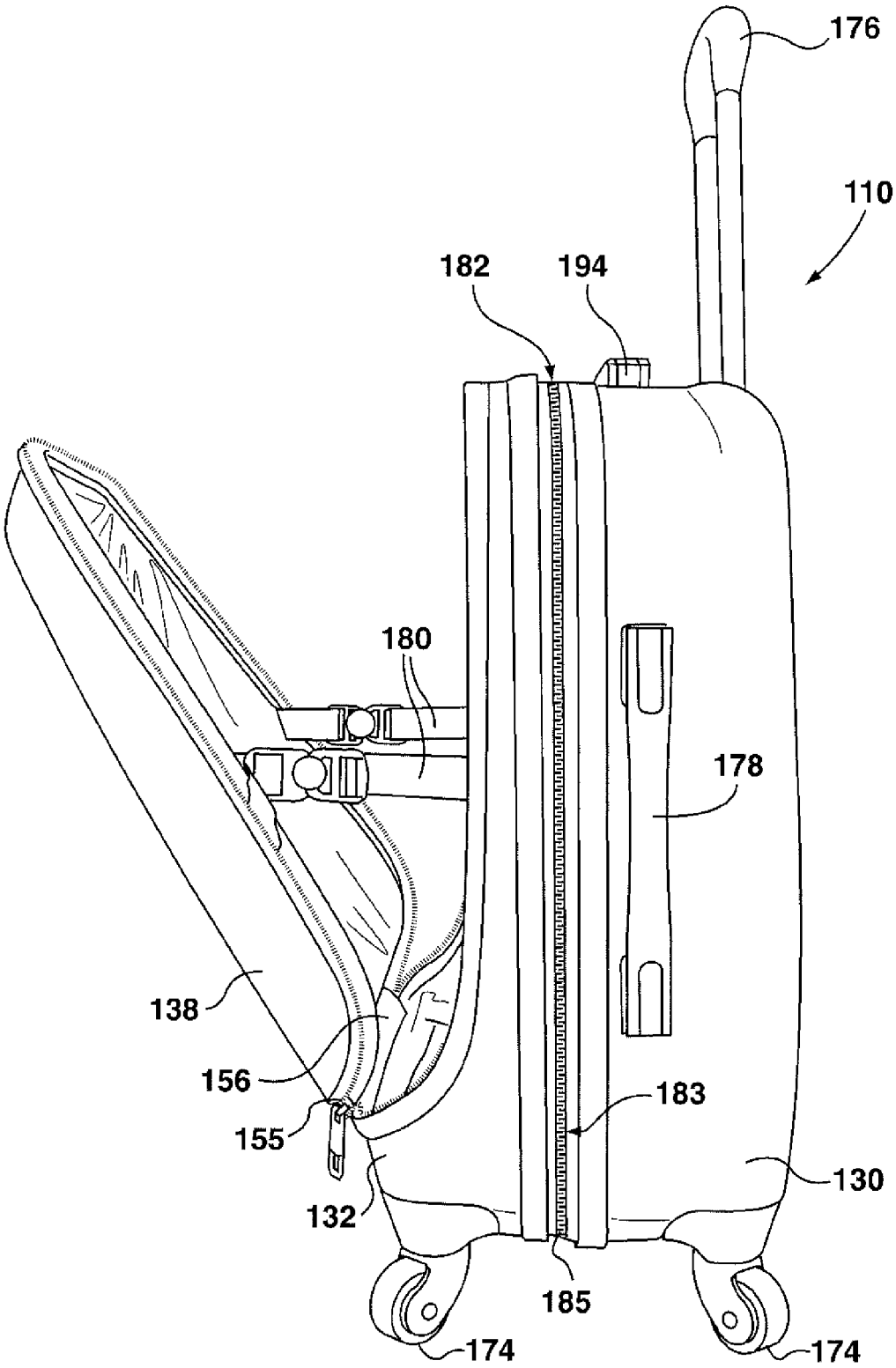
FIG. 9 is a right side view of the hard-sided luggage bag of FIG. 8, shown with a lid in a partially open position.
Figure 10:
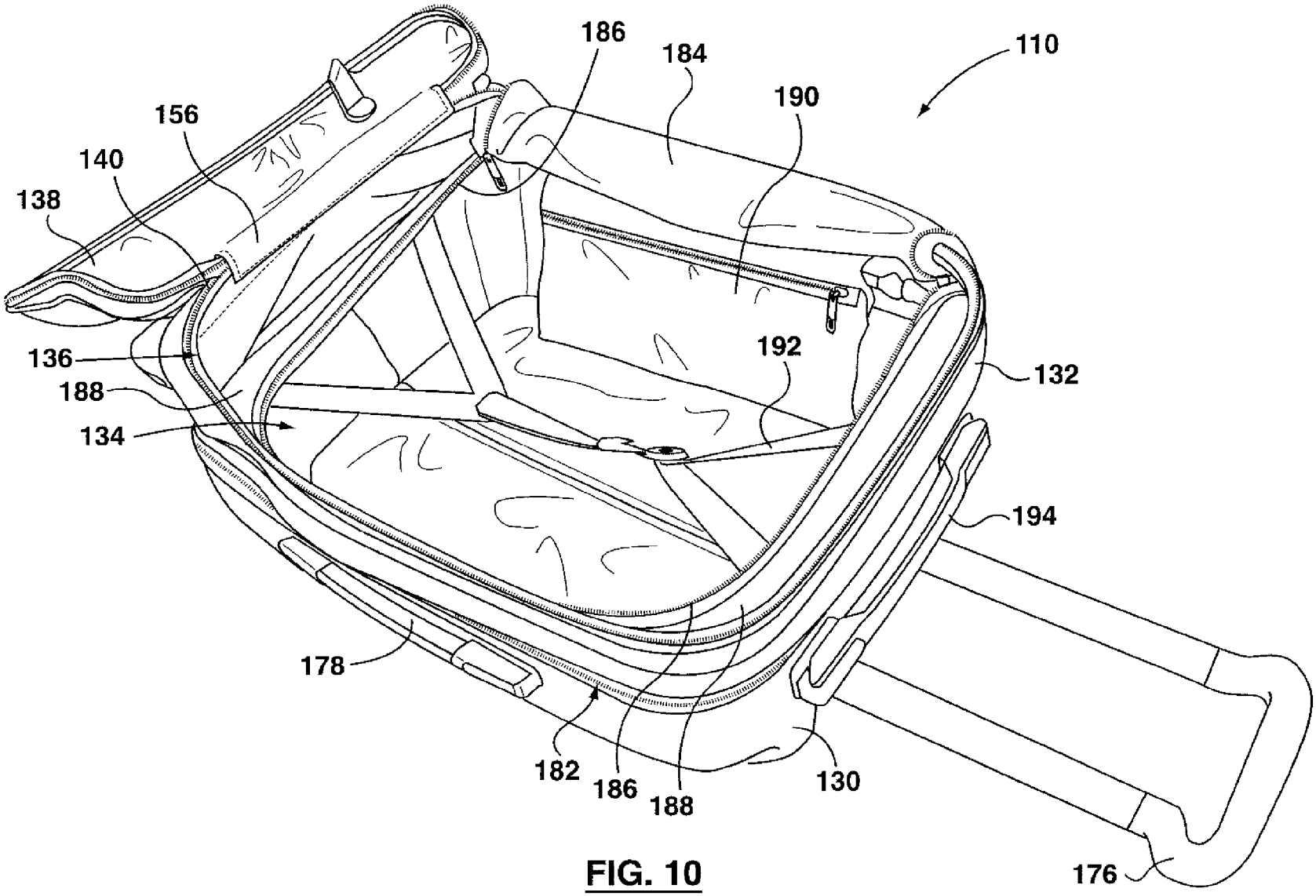
FIG. 10 is a perspective view of the hard-sided luggage bag of FIG. 8, shown with the lid in a fully open position.

Referring now to FIGS. 8, 9 and 10, an example of a hard-sided luggage bag is shown generally at 110. In the example illustrated, the bag 110 includes a rearward shell portion 130 and a forward shell portion 132. The shell portions 130, 132 can be generally complementary in size and shape. The shell portions 130, 132 can be formed of a variety of materials, including, for example but not limited to, aluminum, polycarbonate, ABS, polypropylene, and composites thereof. The shell portions 130, 132 can include an interior lining formed of fabric material.

Referring particularly to FIG. 10, the shell portions 130, 132 are coupled together to enclose a storage compartment 134. The forward shell portion 132 includes an access opening 136 formed therein. The access opening 136 permits access to the storage compartment 134. A lid 138 is coupled to the forward shell portion 132. In an open position, the lid 138 permits access to the storage compartment 134 through the access opening 136. In a depth direction, edges of the access opening 136 are arranged generally adjacent to a front side of the bag 110. Thus, users can have access to almost the full depth of the storage compartment 134 through the access opening 136. Furthermore, in some examples, as illustrated, the sides of the bag 110 can present a generally uniform dimension in the depth direction so that the storage compartment 134 is of a generally uniform depth over the edges of the access opening 136. In a closed position, as shown in FIG. 8, the lid 138 covers the access opening 136.

In the example illustrated, referring again to FIGS. 8, 9 and 10, the lid 138 is shown to be formed of a shell portion, generally in continuity with the forward shell portion 132. Alternatively, in some examples, the lid 138 can be formed of at least one shell portion, at least one fabric portion, or a combination thereof.

The lid 138 is releasably joined to the forward shell portion 132 along edges of the access opening 136 by a lid closure mechanism 154. In the example illustrated, the lid closure mechanism 54 includes a lid zipper 55.

The lid 138 is shown to be releasably joined only partly along a bottom edge 140 of the access opening 136 (FIG. 10), as the lid 138 is connected to the forward shell portion 132 generally along the bottom edge 140 by a hinge 156. The hinge 156 is spaced apart from a bottom side of the bag 110 in a height direction.

Referring particularly to FIG. 9, the arrangement of the hinge 156 can help to reduce the risk of contents falling out of the access opening 136 if the lid 138 is opened while the bag 110 is disposed in an upright position. The bag 110 can include releasable support straps 180 coupled between the lid 138 and the forward shell portion 132. Each of the support straps 180 can include a first member fixed to the lid 138, and a second member fixed to the forward shell portion 132 and attached to the first member. In some examples, the first and second members of the support straps 180 can be attached to each other with a snap buckle. The releasable support straps 180 can be configured to maintain the lid 138 in a partially opened position (shown in FIG. 9), as opposed to a fully opened position (shown in FIG. 10), which can also help to reduce the risk of contents falling out of the access opening 136.

The rearward shell portion 130 is releasably joined to the forward shell portion 132 along a main joint 182 by a main closure mechanism 183. In the example illustrated, the main closure mechanism 183 includes a main zipper 185.

The storage compartment 134 can be accessed by releasing the main closure mechanism 183. Thus, in some examples, the storage compartment 134 can be accessed in two separate ways, namely, through the access opening 136 by releasing the lid closure mechanism 154, or through the main joint 182 by releasing the main closure mechanism 183. The main joint 182 is shown to be generally intermediate front and back sides of the bag 110 so that, once the main closure mechanism 183 is released, the bag 110 can be opened into two roughly equal halves (defined by the rearward shell portion 130 and the forward shell portion 132). Furthermore, the main zipper 185 is shown to be generally spaced apart from the lid zipper 155, which can help to reduce confusion between the main zipper 185 and the lid zipper 155. A hinge (not shown) can also be provided to connect the shell portions 130, 132 together.

In some examples, referring again to FIG. 10, the bag 110 can include a divider 184, which is shown to be partially detached and flipped to one side of the bag 110. The divider 184 can be planar and flexible, e.g., formed of a fabric material, and can be shaped to correspond with an interior cross-section of the storage compartment 134. The divider 184 can be releasably suspended in the storage compartment 134, for example, by a divider zipper 186, which joins edges of the divider 184 to a flap 188 that is fixed to interior side walls of the storage compartment 134. In some examples, a pocket (not shown) can be arranged within the storage compartment 134 for stowing the divider 184 when it is at least partially detached from the flap 188.

When the divider 184 is attached (e.g., by zipping up the divider zipper 186), the divider 184 can divide the storage compartment 134 into two substantially separate subcompartments. In the example illustrated, the divider 184 divides the storage compartment into a front subcompartment (accessible through the lid 138), and a rear subcompartment (accessible through the main joint 182). In some examples, a volume of the front subcompartment can be substantially less than a volume of the rear subcompartment. When the divider 184 is detached, as shown in FIG. 10, generally the full volume of the storage compartment 134 can be accessible to the user by opening either the lid closure mechanism 154 or the main closure mechanism 183.

As illustrated, within the storage compartment 134, the bag 110 can further include at least one interior zippered pocket 190, and one or more restraint straps 192.

Referring again to FIGS. 8 and 9, the bag 110 is also shown to include wheels 174 arranged on a bottom side, and some or all of the wheels 174 can be swivel wheels. In the example illustrated, two of the wheels 174 are fixed to the rearward shell portion 130, and two of the wheels 174 are fixed to the forward shell portion 132. The bag 110 can further include a top handle 194, a retractable handle 176, a side handle 178, and feet 180.

Figure 11:
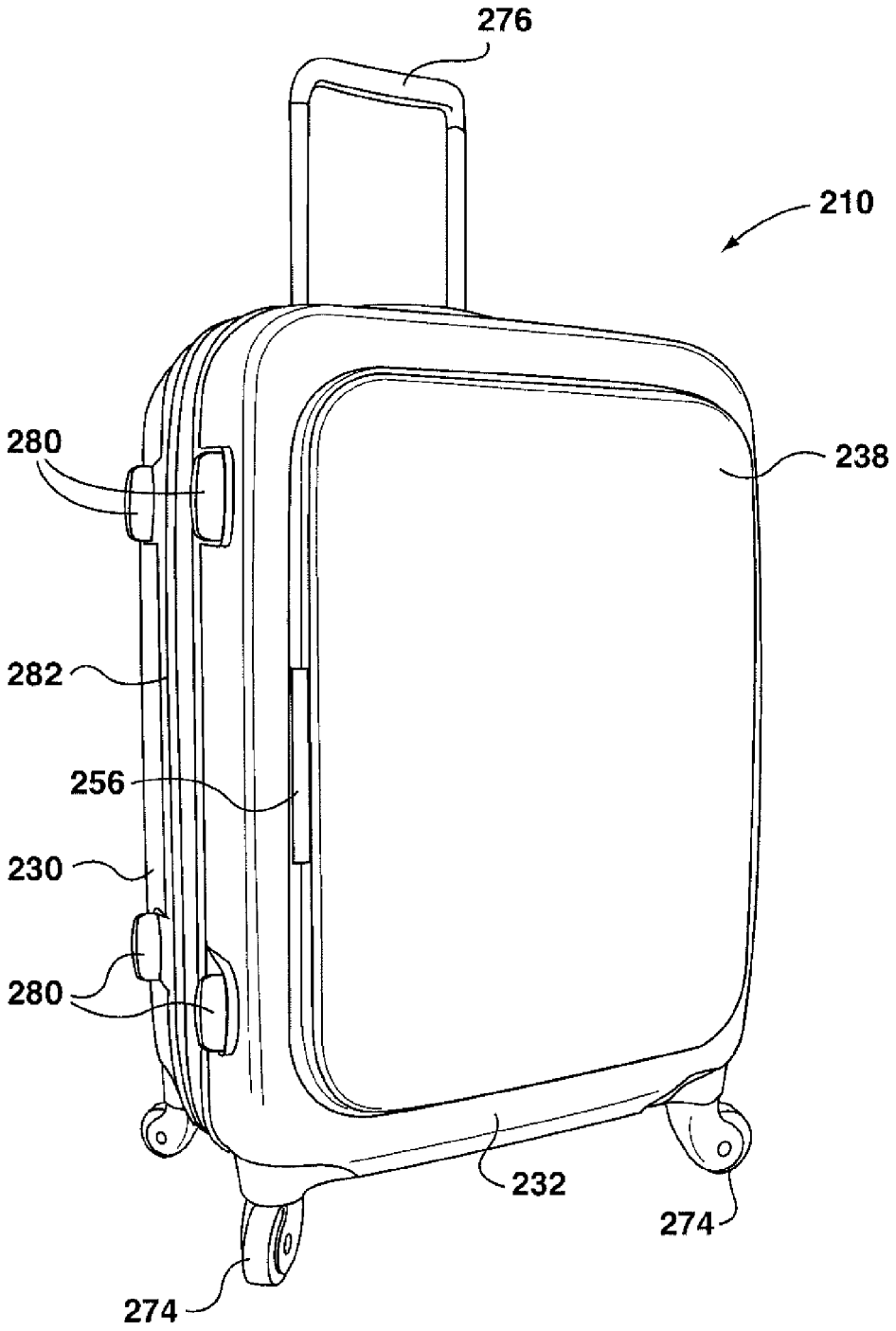
FIG. 11 is a perspective view of a third example of a hard-sided luggage bag.
Figure 12:
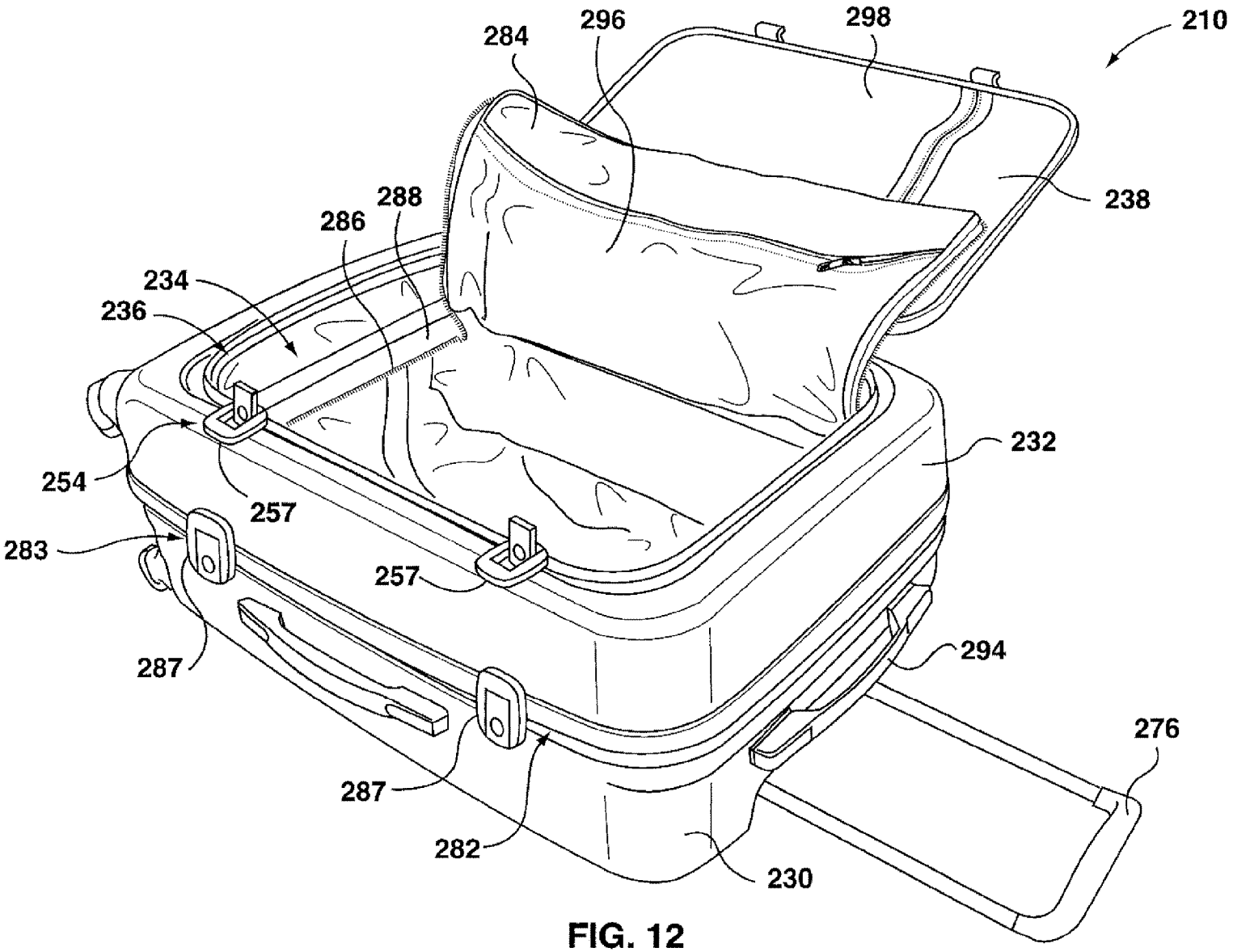
FIG. 12 is a perspective view of the hard-sided luggage bag of FIG. 11, shown with a lid in an open position.

Referring now to FIGS. 11 and 12, an example of a hard-sided luggage bag is shown generally at 210. In the example illustrated, the bag 210 includes a rearward shell portion 230 and a forward shell portion 232. The shell portions 230, 232 can be generally complementary in size and shape. The shell portions 230, 232 can be formed of a variety of materials, including, for example but not limited to, aluminum, polycarbonate, ABS, polypropylene, and composites thereof. The shell portions 230, 232 can include an interior lining formed of fabric material.

Referring particularly to FIG. 12, the shell portions 230, 232 are coupled together to enclose a storage compartment 234. The forward shell portion 232 includes an access opening 236 formed therein. The access opening 236 permits access to the storage compartment 234. A lid 238 is coupled to the forward shell portion 232. In an open position, the lid 238 allows access to the storage compartment 234 through the access opening 236. In a closed position, as shown in FIG. 11, the lid 238 covers the access opening 236.

In the example illustrated, the lid 238 is shown to be formed of a shell portion, and extends generally outwardly relative to the forward shell portion 232. Edges of the access opening 236 are arranged generally adjacent to a front side of the bag 210. Thus, users can have access to almost the full depth of the storage compartment 234 through the access opening 236. Furthermore, the storage compartment 234 is of a generally uniform depth along the edges of the access opening 236.

The lid 238 is releasably joined to the forward shell portion 232 along edges of the access opening 236 by a lid closure mechanism 254. In the example illustrated, the lid closure mechanism 254 includes lid clasps 257. In such examples, the lid closure mechanism 254 can also include a rigid frame which extends along edges of the lid 238 and/or the edges of the access opening 236 to ensure that the lid 238 correctly mates with the forward shell portion 232 when closed.

The lid 238 is shown (FIG. 11) releasably joined only partly along the left edge of the access opening 236, as the lid 238 is connected to the forward shell portion 232 generally along the left edge by a hinge 256.

The rearward shell portion 230 is releasably joined to the forward shell portion 232 along a main joint 282 by a main closure mechanism 283. In the example illustrated, the main closure mechanism 283 includes main clasps 287. In such examples, the main closure mechanism 283 can also include a rigid frame which extends along inner edges of the shell portions 230, 232 to ensure that they correctly mate when closed.

The storage compartment 234 can be accessed by releasing the main closure mechanism 283. Thus, in some examples, the storage compartment 234 can be accessed in two separate ways, namely, through the access opening 236 by releasing the lid closure mechanism 254, or through the main joint 282 by releasing the main closure mechanism 283. The main joint 282 is shown to be generally intermediate front and back sides of the bag 210 so that, once the main closure mechanism 283 is released, the bag 210 can be opened into two roughly equal halves (defined by the rearward shell portion 230 and the forward shell portion 232). Furthermore, the lid clasps 257 are shown to be generally spaced apart from the main clasps 287, which can help to reduce confusion between the lid closure mechanism 254 and the main closure mechanism 283. A hinge (not shown) can also be provided to connect the shell portions 230, 232 together.

In the example illustrated, referring particularly to FIG. 12, the bag 210 includes a divider 284. The divider 284 can be planar and flexible, e.g., formed of a fabric material, and can be shaped to correspond with an interior cross-section of the storage compartment 234. The divider 284 can be releasably suspended in the storage compartment 234, for example, by a divider zipper 286, which joins edges of the divider 284 to a flap 288 that is fixed to interior side walls of the storage compartment 234. In some examples, a pocket (not shown) can be arranged within the storage compartment 234 for stowing the divider 284 when it is at least partially detached from the flap 288.

When the divider 284 is attached (i.e. by zipping up the divider zipper 286), the divider 284 can divide the storage compartment 234 into two substantially separate subcompartments. In the example illustrated, the divider 284 divides the storage compartment 234 into a front subcompartment (accessible through the lid 238), and a rear subcompartment (accessible through the main joint 282). In some examples, a volume of the front subcompartment can be substantially less than a volume of the rear subcompartment. When the divider 284 is detached, as shown in FIG. 12, generally the full volume of the storage compartment 234 can be accessible to the user by opening either the lid closure mechanism 254 or the main closure mechanism 283.

In the example illustrated, the divider 284 includes a zippered pocket 296. In some examples, the zippered pocket 296 can span generally the full length and width of the divider 284. Furthermore, as illustrated, the lid 238 can include a zippered pocket 298 arranged along an interior side thereof. The zippered pocket 298 can span generally the full length and width of the lid 238.

The bag 210 is shown to include wheels 274 arranged on a bottom side, and some or all of the wheels 274 can be swivel wheels. In the example illustrated, two of the wheels 274 are fixed to the rearward shell portion 230, and two of the wheels 274 are fixed to the forward shell portion 232. The bag 210 is also shown to include a top handle 294, a retractable handle 276, a side handle 278, and feet 280.

Referring now to FIGS. 13, 14, 15 and 16, an example of a hard-sided luggage bag is shown generally at 310. In the example illustrated, the bag 310 includes a rearward shell portion 330 and a forward shell portion 332. The shell portions 330, 332 can be generally complementary in size and shape. The shell portions 330, 332 can be formed of a variety of materials, including, for example but not limited to, aluminum, polycarbonate, ABS, polypropylene, and composites thereof. The shell portions 330, 332 can include an interior lining formed of fabric material.

Figure 16:
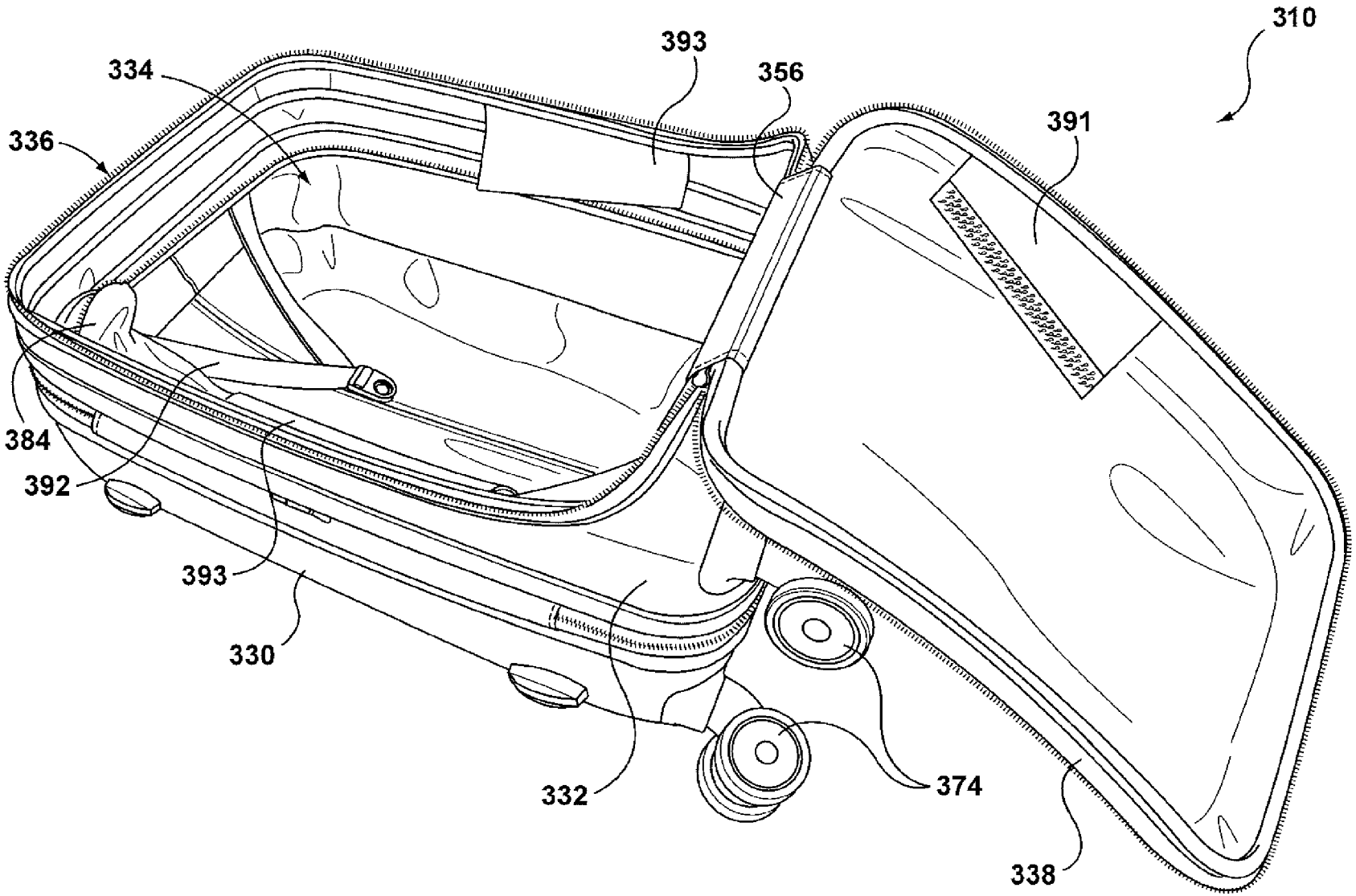
FIG. 16 is a perspective view of the hard-sided luggage bag of FIG. 13, shown with the lid in an open position.

Referring particularly to FIG. 16, the shell portions 330, 332 are coupled together to enclose a storage compartment 334. The forward shell portion 332 includes an access opening 336 formed therein. The access opening 336 permits access to the storage compartment 334. A lid 338 is coupled to the forward shell portion 332. In an open position, the lid 338 allows access to the storage compartment 334 through the access opening 336. In a depth direction, edges of the access opening 336 are arranged generally adjacent to a front side of the bag 310. Thus, users can have access to almost the full depth of the storage compartment 334 through the access opening 336. Furthermore, in some examples, as illustrated, the sides of the bag 310 can present a generally uniform dimension in the depth direction so that the storage compartment 334 is of a generally uniform depth over the edges of the access opening 336. In a closed position, the lid 338 covers the access opening 336.

Figure 13:
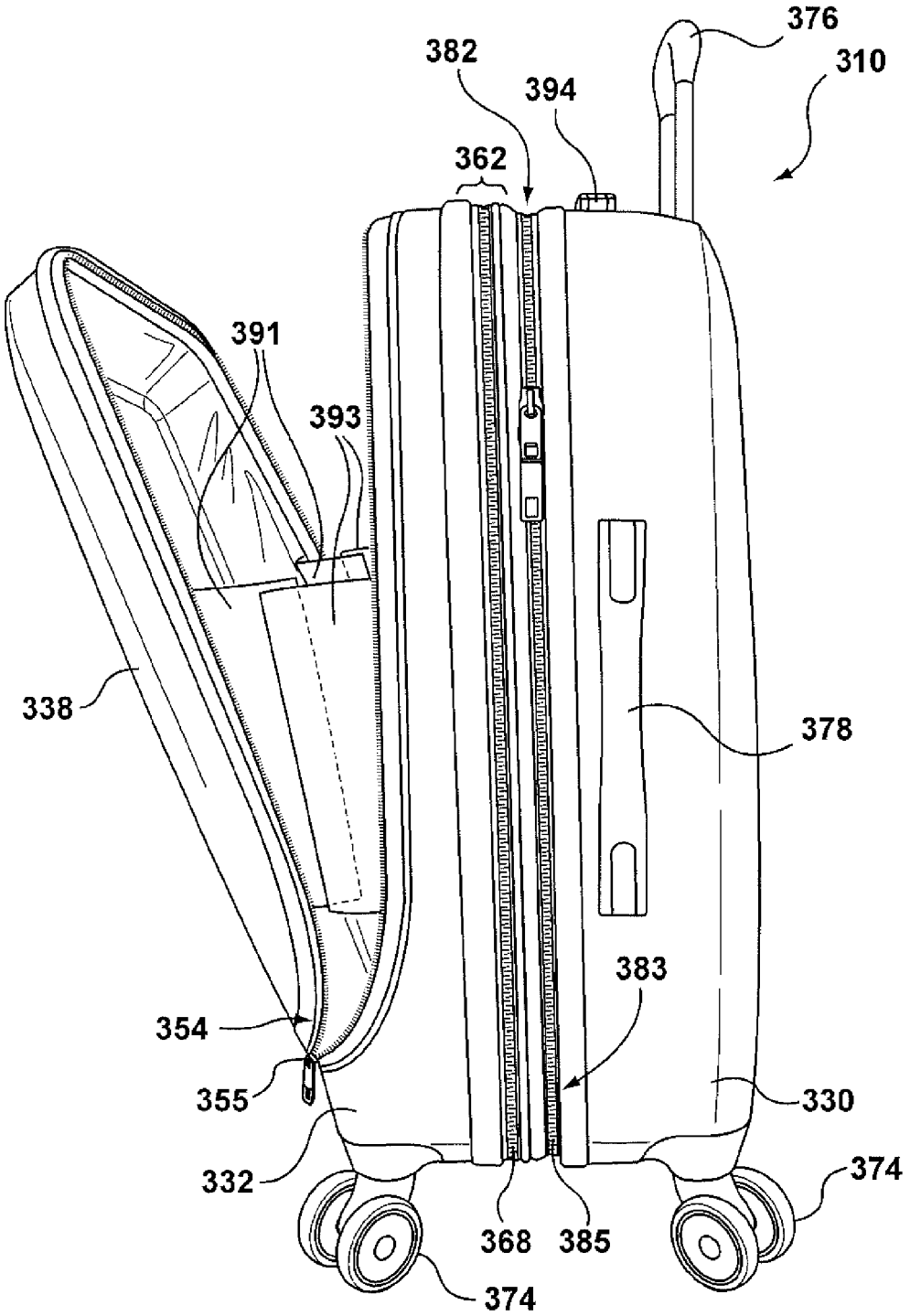
FIG. 13 is a right side view of a fourth example of a hard-sided luggage bag, shown with a lid in a partially open position.
Figure 14:
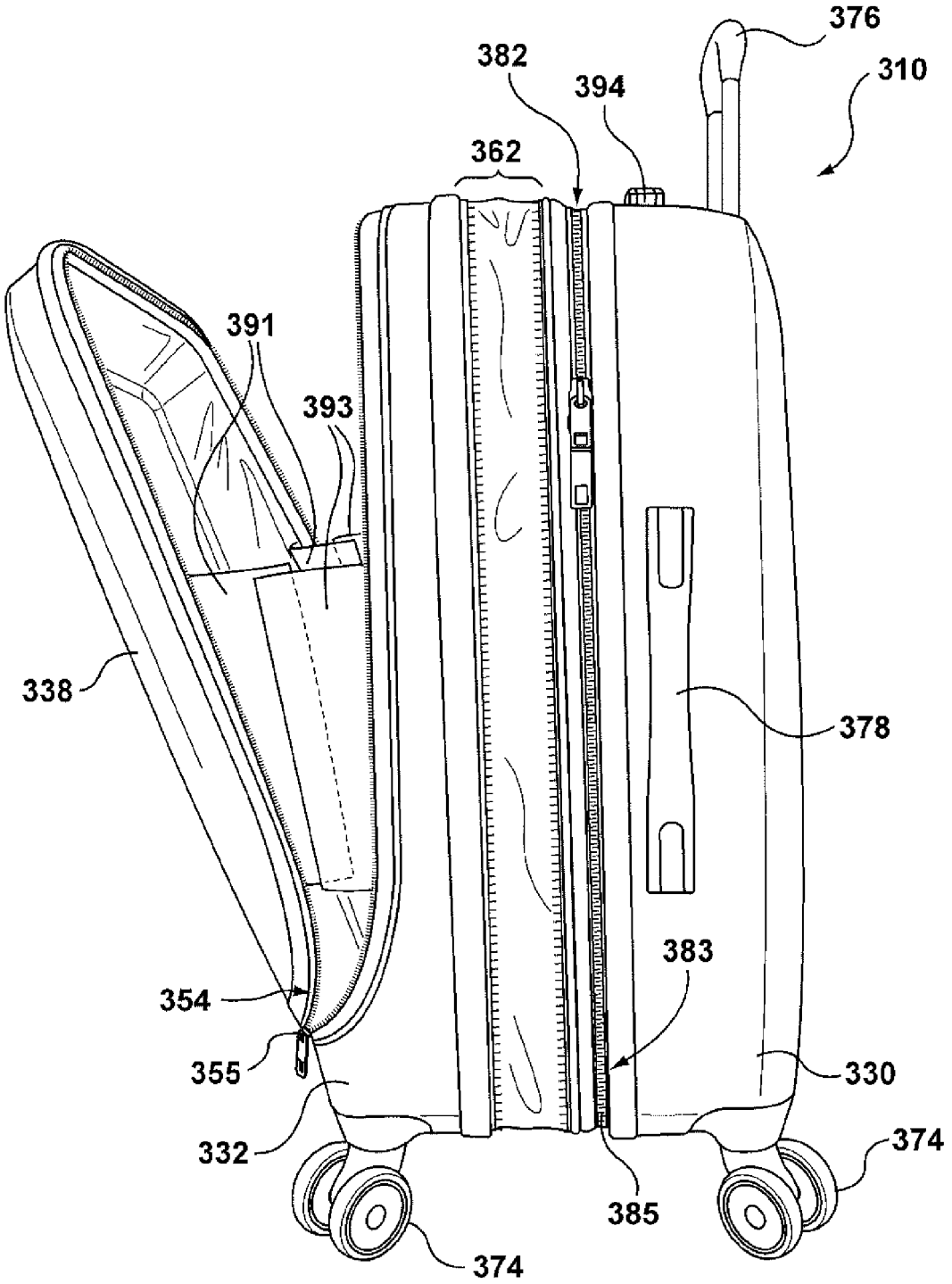
FIG. 14 is another right side view of the hard-sided luggage bag of FIG. 13, shown with an expansion section in a released position.
Figure 15:
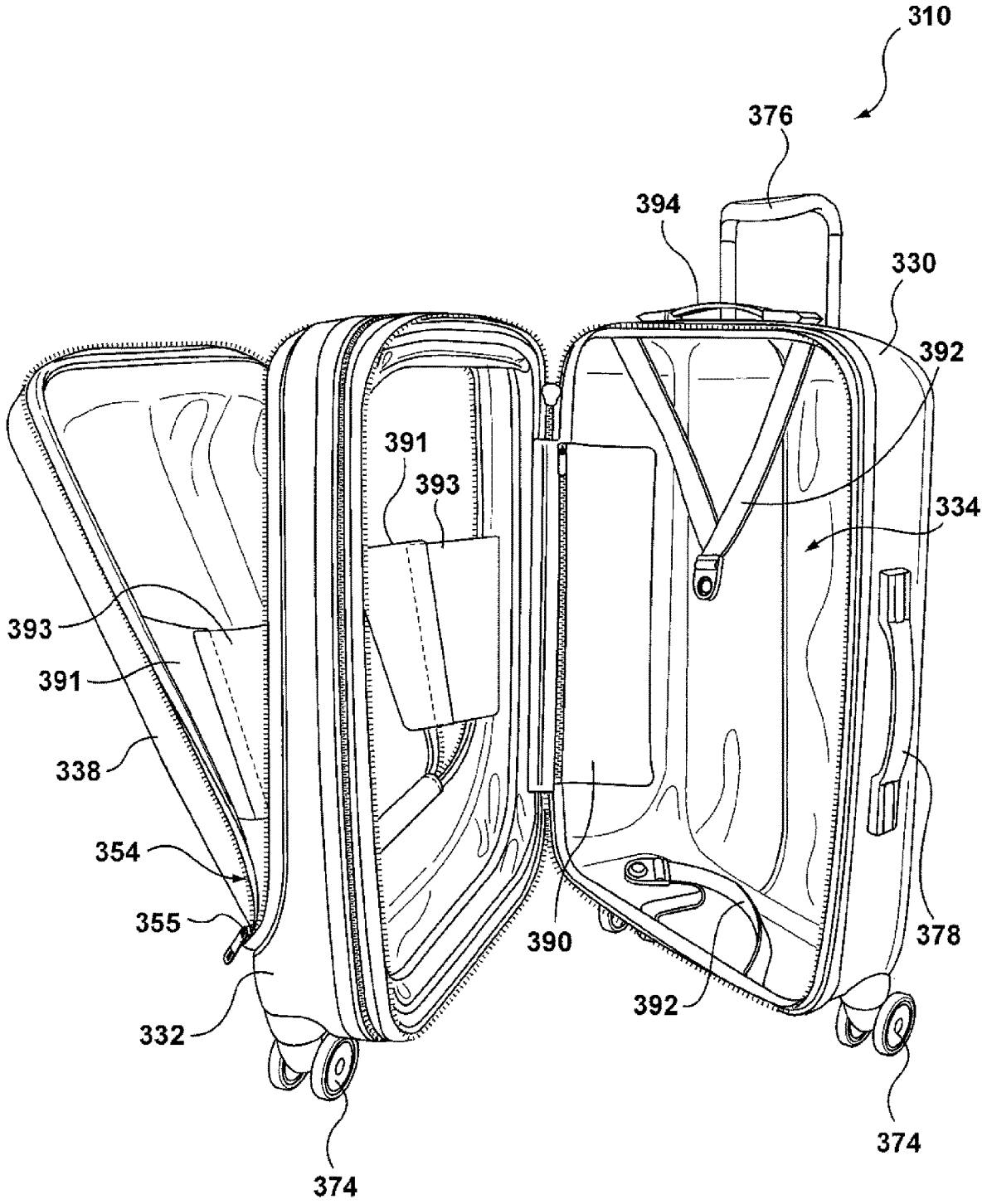
FIG. 15 is another right side view of the hard-sided luggage bag of FIG. 13, shown with a main closure mechanism in a released position.

Referring particularly to FIGS. 13 and 14, the lid 338 is formed of a shell portion, generally in continuity with the forward shell portion 332. Alternatively, in some examples, the lid 338 can be formed of at least one shell portion, at least one fabric portion, or a combination thereof.

The lid 338 is releasably joined to the forward shell portion 332 along edges of the access opening 336 by a lid closure mechanism 354. In the example illustrated, the lid closure mechanism 354 includes a lid zipper 355.

The lid 338 is shown to be releasably joined only partly along a bottom edge of the access opening 336, as the lid 338 is connected to the forward shell portion 332 generally along the bottom edge by a hinge 356 (FIG. 16). The hinge 356 is spaced apart from a bottom side of the bag 310 in a height direction.

The rearward shell portion 330 is releasably joined to the forward shell portion 332 along a main joint 382 by a main closure mechanism 383. In the example illustrated, the main closure mechanism 383 includes a main zipper 385.

The storage compartment 334 can be accessed by releasing the main closure mechanism 383. Thus, in some examples, the storage compartment 334 can be accessed in two separate ways, namely, through the access opening 336 by releasing the lid closure mechanism 354, or through the main joint 382 by releasing the main closure mechanism 383.

The main joint 382 is shown to be generally intermediate front and back sides of the bag 310 so that, once the main closure mechanism 383 is released, the bag 310 can be opened into two roughly equal halves (defined by the rearward shell portion 330 and the forward shell portion 332). Furthermore, the main closure mechanism 383 is shown to be generally spaced apart from the lid closure mechanism 354, which can help to reduce confusion between the main zipper 385 and the lid zipper 355. A hinge (not shown) can also be provided to connect the shell portions 330, 332 together.

With continued reference to FIGS. 13 and 14, an expansion section 362 is shown to be connected to an inner edge of the forward shell portion 332 and a forward edge of the main joint 382. In the example illustrated, the expansion section 362 includes an expansion zipper 368, which, when released, increases space between the inner edge of the forward shell portion 332 and the forward edge of the main joint 382, thereby increasing a depth dimension of the bag 310.

In the example illustrated, the expansion section 362 is shown to be arranged adjacent to the main joint 382, but generally intermediate front and back sides of the bag 310, so that a center of gravity of the bag 310 can remain generally balanced between the front and back sides once the expansion zipper 368 is released.

In some examples, referring again to FIG. 16, the bag 310 can include a divider 384, which is shown to be partially detached and rolled up to one side of the storage compartment 334. The divider 384 can be planar and flexible, e.g., formed of a fabric material, and can be shaped to correspond with an interior cross-section of the storage compartment 334. The divider 384 can be releasably suspended in the storage compartment 334, for example, by a divider zipper, which joins edges of the divider 384 to one or more flaps that are fixed to interior side walls of the storage compartment 334. In some examples, a pocket (not shown) can be arranged within the storage compartment 334 for stowing the divider 384 when it is at least partially detached from the one or more flaps.

When the divider 384 is attached (e.g., by zipping up the divider zipper), the divider 384 can divide the storage compartment 334 into two substantially separate subcompartments. In the example illustrated, the divider 384 divides the storage compartment into a front subcompartment (accessible through the lid 338), and a rear subcompartment (accessible through the main joint 382). In some examples, a volume of the front subcompartment can be substantially less than a volume of the rear subcompartment. When the divider 384 is detached, as shown in FIG. 16, generally the full volume of the storage compartment 334 can be accessible to the user by opening either the lid closure mechanism 354 or the main closure mechanism 383.

In the example illustrated, the hinge 356 being arranged on the bottom edge of the access opening 336 can help to reduce the risk of contents falling out of the access opening 336 if the lid 338 is opened while the bag 310 is disposed in an upright position. The bag 310 includes gussets provided alongside edges of the access opening 336. In the example illustrated, the gussets are formed by first members 391 fixed to the lid 338, and second members 393 fixed to the forward shell portion 332 and attached to the first members 391. In some examples, the first and second members 391, 393 can be attached using a hook-and-loop fastener. The first and second members 391, 393 can be configured to maintain the lid 338 in a partially opened position (shown in FIGS. 13, 14 and 15), as opposed to a fully opened position (shown in FIG. 16), which can also help to reduce the risk of contents falling out of the access opening 336.

As illustrated, within the storage compartment 334, the bag 310 can further include at least one interior zippered pocket 390, and one or more restraint straps 392.

The bag 310 is shown to include wheels 374 arranged on a bottom side, and some or all of the wheels 374 can be swivel wheels. In the example illustrated, two of the wheels 374 are fixed to the rearward shell portion 330, and two of the wheels 374 are fixed to the forward shell portion 332. The bag 310 is also shown to include a top handle 394, a retractable handle 376, and a side handle 378.

While the above description provides examples of one or more apparatuses or methods, it will be appreciated that other apparatuses or methods may be within the scope of the accompanying claims.

We claim:

1. A hard-sided luggage bag, comprising:

at least one shell portion having a front side, a back side, and top, bottom, left and right sides extending generally between the front and back sides, the front and back sides spaced from one another in a depth direction, the top and bottom sides spaced from one another in a height direction, the at least one shell portion enclosing a storage compartment and comprising an access opening permitting access to the storage compartment, the access opening formed in at least part of the front side; and at least one lid releasably coupled to the at least one shell portion to cover the access opening, wherein the at least one lid is releasably joined to the at least one shell portion along a bottom edge of the access opening, wherein the bottom edge is spaced from the bottom side in the height direction, wherein the bottom edge extends across the front side between the left and right sides, wherein the at least one lid is releasably joined to the at least one shell portion along left, top and right edges of the access opening that extend across the respective left, top and right sides of the at least one shell portion, wherein the at least one shell portion comprises a rearward shell portion coupled to a forward shell portion by at least one of a main joint and an expansion section that, in the depth direction, is generally intermediate the front and back sides, the forward shell portion comprising the access opening, wherein, along the left side, a first dimension between an interior edge of the forward shell portion and the left edge of the access opening is less than a second dimension between the left edge of the access opening and the bottom edge of the access opening at the front side, and wherein the first and second dimensions are parallel to the depth direction.

2. The hard-sided luggage bag of claim 1, wherein the shell portions are releasably joined along the main joint by a main closure mechanism, the main joint permitting a first way to access the storage compartment by releasing the main closure mechanism, and the access opening permitting a second way to access the storage compartment, separate from the first way, by releasing a lid closure mechanism.

3. The hard-sided luggage bag of claim 1, wherein the access opening comprises curved bottom corners arranged intermediate of the bottom edge and the left and right edges, and, along the left side, a third dimension between the left edge of the access opening and boundary between the curved corner of the access opening and the bottom edge of the access opening is less than a fourth dimension between the boundary between the curved corner of the access opening and the bottom edge of the access opening at the front side, the third and fourth dimensions being parallel to the depth direction.

4. The hard-sided luggage bag of claim 3, wherein, along the left and right sides, the bottom edge extends parallel to the depth direction between the front side and each of the curved corners.

5. The hard-sided luggage bag of claim 1, wherein the access opening comprises curved bottom corners arranged intermediate of the bottom edge and the left and right edges, and, along the left and right sides, the bottom edge extends parallel to the depth direction between the front side and each of the curved corners.

6. The hard-sided luggage bag of claim 1, wherein the left, top and right sides present a generally uniform dimension in the depth direction so that the storage compartment is of a generally uniform depth over the left, top and right edges of the access opening.

7. The hard-sided luggage bag of claim 1, wherein the at least one lid is releasably joined to the at least one shell portion by a lid closure mechanism, and the lid closure mechanism comprises at least one of a zipper and a clasp.

8. The hard-sided luggage bag of claim 1, wherein the at least one lid comprises at least one shell portion, at least one fabric portion, at least one zippered pocket, or a combination thereof.

9. The hard-sided luggage bag of claim 1, comprising a hinge connecting the at least one lid to the at least one shell portion, and the hinge is arranged along one of the left, bottom, top and right edges of the access opening.

10. The hard-sided luggage bag of claim 1, comprising at least one of a support strap and a gusset connected generally between the at least one lid and the at least one shell portion for maintaining the at least one lid in a partially open position, the at least one of a support strap and a gusset comprises a first member fixed to the at least one lid, and a second member fixed to the at least one shell portion and attached to the first member, and the first and second members are detachable from one another so that the at least one lid is movable to a fully open position.

11. The hard-sided luggage bag of claim 1, comprising a plurality of wheels arranged on the bottom side, the plurality of wheels comprising at least one wheel fixed to the rearward shell portion and at least one wheel fixed to the forward shell portion.

12. The hard-sided luggage bag of claim 1, comprising a divider that is releasably suspended in the storage compartment to divide the storage compartment into at least two substantially separate subcompartments.

13. The hard-sided luggage bag of claim 12, wherein the divider divides the storage compartment into a front subcompartment and a rear subcompartment, and a volume of the front subcompartment is substantially less than a volume of the rear subcompartment.

14. The hard-sided luggage bag of claim 12, wherein the divider is at least partially detachable.

15. The hard-sided luggage bag of claim 12, wherein the divider comprises a zippered pocket.

16. A hard-sided luggage bag, comprising:

a rearward shell portion coupled to a forward shell portion, the shell portions together having a front side, a back side spaced from the front side, and top, bottom, left and rights sides extending generally between the front and back sides, the front and back sides spaced from one another in a depth direction, the top and bottom sides spaced from one another in a height direction, the shell portions being coupled by at least one of a main joint and an expansion section that, in the depth direction, is generally intermediate the front and back sides, the shell portions enclosing a storage compartment, the forward shell portion comprising an access opening permitting access to the storage compartment, the access opening formed in at least part of the front side, the access opening comprising a bottom edge that is spaced from the bottom side in the height direction and extends across the front side between the left and right sides, and the access opening comprising left, top and right edges that extend across respective left, top and right sides of the forward shell portion; and a lid coupled to the forward shell portion to cover the access opening and defining a substantial portion of the front side of the bag, the lid releasably joined to the forward shell portion by a lid closure zipper along at least a portion of the bottom, left and top edges of the access opening, wherein, along the left side of the bag at a vertical position that, in the height direction, is generally intermediate the top and bottom sides, a first horizontal dimension between an interior edge of the forward shell portion and the left edge of the access opening is less than a second horizontal dimension between the lid closure zipper at the left edge of the access opening and the front side of the lid.

17. The hard-sided luggage bag of claim 16, wherein the left, top and right sides present a generally uniform dimension in the depth direction so that the storage compartment is of a generally uniform depth over the left, top and right edges of the access opening.

18. The hard-sided luggage bag of claim 17, wherein the shell portions are releasably joined along the main joint by a main closure zipper, the main joint permitting a first way to access the storage compartment by releasing the main closure zipper, and the access opening permitting a second way to access the storage compartment, separate from the first way, by releasing the lid closure zipper.

19. The hard-sided luggage bag of claim 17, comprising the expansion section arranged generally between the shell portions, and the expansion section is spaced apart from the lid.

20. A hard-sided luggage bag, comprising:

a rearward shell portion releasably joined to a forward shell portion along a main joint, the shell portions enclosing a storage compartment, the main joint permitting a first way to access the storage compartment by releasing a main closure mechanism, the forward shell portion comprising an access opening permitting a second way to access the storage compartment, separate from the first way, by releasing a lid closure mechanism; and a lid releasably coupled to the forward shell portion to cover the access opening, wherein the lid defines a substantial portion of a front side of the bag, wherein the access opening comprises bottom, left and right edges, wherein the bottom edge is spaced vertically from a bottom side of the bag in a height direction, and extends horizontally across a front side of the forward shell portion, wherein the left and right edges of the access opening extend across respective left and right sides of the forward shell portion, and wherein, along the left side, a first horizontal dimension between an interior edge of the forward shell portion and the left edge of the access opening is less than a second horizontal dimension between the left edge of the access opening and the front side of the bag as defined by the lid.

* * * * *